US005816013A

United States Patent [19]

Opferbeck et al.

[11] Patent Number: 5,816,013

[45] Date of Patent: Oct. 6, 1998

[54] CURVED HOLLOW PANEL AND METHOD FOR MANUFACTURE

[75] Inventors: Kevin W. Opferbeck, Ashville; Lawrence P. Tocha, Little Valley, both of N.Y.

[73] Assignee: Bush Industries, Inc., Jamestown, N.Y.

[21] Appl. No.: 731,072

[22] Filed: Oct. 9, 1996

[51] Int. Cl.[6] ..... B27H 1/00

[52] U.S. Cl. ..... 52/745.19; 52/246; 52/249; 52/631; 144/349; 144/381

[58] Field of Search ..... 52/631, 245, 246, 52/249, 730.7, 223.8, 745.19, 746.1; 108/156; 144/349, 381

[56] References Cited

U.S. PATENT DOCUMENTS

| | | | |
|---|---|---|---|
| 187,449 | 2/1877 | Burr | 52/631 X |
| 435,337 | 8/1890 | Wassenius . | |
| 1,876,772 | 9/1932 | Sievers . | |
| 2,020,044 | 11/1935 | Tesek . | |
| 2,108,479 | 2/1938 | Elmendorf . | |
| 2,181,164 | 11/1939 | Alexander | 52/631 |
| 2,253,219 | 8/1941 | Alexander | 52/631 X |
| 2,508,128 | 5/1950 | Waards | 52/249 X |
| 2,701,746 | 2/1955 | Piggott . | |
| 2,706,164 | 4/1955 | Hervey . | |
| 2,791,809 | 5/1957 | Lincoln, Jr. . | |
| 2,890,731 | 6/1959 | Maffei | 52/631 X |
| 3,325,233 | 6/1967 | Oppenhuizen et al. . | |
| 3,557,840 | 1/1971 | Maybee | 52/631 X |
| 3,654,053 | 4/1972 | Toedter | 52/631 X |
| 3,706,173 | 12/1972 | Taylor | 52/631 X |
| 3,958,385 | 5/1976 | Bondra, Jr. et al. | 52/631 X |
| 4,093,762 | 6/1978 | Kiefer . | |
| 4,235,057 | 11/1980 | Teeters . | |
| 4,360,021 | 11/1982 | Stima . | |
| 4,429,012 | 1/1984 | Danko . | |
| 4,624,094 | 11/1986 | Schwindt . | |
| 4,635,425 | 1/1987 | Cova . | |

(List continued on next page.)

FOREIGN PATENT DOCUMENTS

| | | | |
|---|---|---|---|
| 876313 | 11/1942 | France . | |
| 1013087 | 7/1952 | France . | |
| 1101526 | 10/1955 | France . | |
| 1347082 | 11/1963 | France . | |
| 929028 | 6/1955 | Germany . | |
| 1965324 | 7/1970 | Germany | 52/631 |
| 7310525 | 2/1975 | Netherlands . | |
| 86407 | 5/1936 | Sweden . | |
| 114548 | 7/1945 | Sweden . | |
| 132895 | 9/1951 | Sweden . | |
| 9566 | 11/1894 | Switzerland . | |
| 285871 | 1/1953 | Switzerland . | |
| 314233 | 7/1956 | Switzerland . | |
| 553254 | 5/1943 | United Kingdom . | |
| 686699 | 1/1953 | United Kingdom | 52/631 |

*Primary Examiner*—Carl D. Friedman
*Assistant Examiner*—Laura A. Callo
*Attorney, Agent, or Firm*—Webb Ziesenheim Bruening Logsdon Orkin & Hanson, P.C.

[57] ABSTRACT

A curved panel for use in furniture. The curved panel includes a sheet which in a free state is flat. A plurality of pins are secured to opposite ends of the sheet. One or more members are provided for engaging the pins to maintain the sheet in a curved state. The curved panel can include two spaced apart sheets and a frame defined by a plurality of curvable rails or spaced apart blocks and non-curvable rails that extend about a perimeter of the sheets. The frame is positioned between the sheets so that the curvable rails or spaced apart blocks and sheets are curved about an axis of curvature. Each curvable rail includes a slotted rail having a plurality of ribs defining slots therebetween. A plurality of pins are secured to the non-curvable rails and pass through holes defined in one of the sheets so as to maintain the sheets in a curved state. The curved panel can also be formed by a sheet having pins secured thereto, where the pins are received by template guides to maintain the sheet in a curved state. The curved panels can form curved legs for a table. Also disclosed are methods for manufacturing a curved panel.

13 Claims, 9 Drawing Sheets

U.S. PATENT DOCUMENTS 4,671,035 6/1987 Ridge ..... 52/631 X
4,741,945 5/1988 Brant et al. .
4,753,696 6/1988 Monzo .
4,843,781 7/1989 Chase, III .
4,894,974 1/1990 Mayhew et al. .
5,077,948 1/1992 Olson et al. .
5,197,256 3/1993 Martin .
5,369,930 12/1994 Kreizinger .
5,396,750 3/1995 Kleyn .

CURVED HOLLOW PANEL AND METHOD FOR MANUFACTURE

BACKGROUND OF THE INVENTION

1) Field of the Invention

This invention relates to panels, and more particularly, to curved panels that can be used in furniture and other products.

2) Description of the Prior Art

Prior to the twentieth century, furniture makers manufactured furniture from solid wood and by hand. Typically, this furniture was made from flat boards, which were cut or machined to the desired shape and design. This generally resulted in box-shaped furniture having flat surfaces.

During the twentieth century, furniture manufacturing techniques improved. This resulted in more production of many wooden furniture products at a relatively inexpensive cost to the purchaser. However, the furniture still appeared for the most part boxy since the furniture typically included flat panels. Curved wooden panels were available, but were expensive to manufacture and, therefore, were provided on only a few furniture designs. With the advent of plastic materials and laminates, the shape of furniture dramatically changed. For the first time, curved furniture panels were possible at an affordable price. Although the curved features were well received in the marketplace, many purchasers still preferred wooden furniture.

The cost of furniture grade wood and the associated labor costs have increased drastically in recent years causing many furniture manufacturers to react by creating alternatives to solid wood panels used for furniture and alternatives to preassembled furniture. Some furniture manufacturers have turned to the use of solid furniture panels made of particle board having veneered surfaces. Although these panels can be substituted for wooden panels, they are extremely heavy due to the makeup of particle board (wood and glue). Alternatively, lightweight hollow flat panels have been used, where each hollow panel includes two sheets sandwiching a plurality of side rails.

Other furniture manufacturers have turned to selling ready-to-assemble (RTA) furniture, in lieu of preassembled furniture. RTA furniture requires assembly by the purchaser. Specifically, the purchaser is provided with furniture components and the necessary hardware to assemble the furniture, such as side panels, shelves and fasteners. Typically, cardboard boxes contain the preassembled furniture. The box dimensions must be kept at a minimum so as to minimize storage costs and transportation costs. This criteria dictates the use of flat panels in RTA furniture, which in turn tends to appear boxy when assembled. Although curved panels would be a welcome change for the purchasers of RTA furniture, their size alone makes storage and transportation costs prohibitively expensive.

Therefore, it is an object of the present invention to provide a curved panel for use in RTA furniture.

SUMMARY OF THE INVENTION

The present invention is a curved panel including two spaced apart sheets and a curvable rail positioned between and secured to the sheets. The curvable rail and the sheets are curved about an axis of curvature. The curvable rail can be a slotted rail having a plurality of ribs defining slots therebetween and is adapted to be curved about the axis of curvature. The ribs can include curved surfaces that abut against one of the sheets. A plurality of curvable and non-curvable rails can be secured to the sheets to define a frame extending about the perimeter of the sheets. Preferably, the sheets are rectangularly shaped prior to being curved, where the sheets extend in a lateral direction and a longitudinal direction and sheets are curved about the lateral direction. Preferably, each of the sheets has the same longitudinal dimensions and different lateral dimensions. A plurality of pins can be secured to one of the sheets that pass through holes defined on the other of the sheets. The curved panel can be used in a piece of furniture.

Another aspect of the present invention is a method for manufacturing a curved panel including the steps of: attaching slotted rails to a flat first sheet; curving the first sheet and the slotted rails about an axis of curvature; curving a flat second sheet about the axis of curvature; and securing the second sheet and the first sheet.

Another aspect of the present invention is a curved panel that includes two spaced apart sheets and a plurality of spaced blocks positioned along first and second opposite edges of the sheets and sandwiched between the sheets. The first and second opposite edges are curved about an axis of curvature. Two rails can be positioned along third and fourth opposite edges of the sheets. The first and second opposite edges are transverse to the third and fourth opposite edges. A plurality of pins are secured to one of the sheets and passed through holes defined on the other of the sheets. The pins interact with the other of the sheets so as to maintain the sheets in a curved state.

Another aspect of the present invention is a method of manufacturing a curved panel, including the steps of: attaching a plurality of spaced blocks to a first flat sheet; curving the first sheet and moving the blocks relative to each other about an axis of curvature; and curving a second sheet about the axis of curvature and securing the second sheet to the first sheet to form a curved panel.

Another aspect of the present invention is a curved panel that includes a first sheet, a plurality of sets of pins secured to the first sheet and extending from opposite ends of the first sheet and two end members engaging with the sets of pins so as to maintain the first sheet in a curved state. A plurality of longitudinally extending rails are secured to the first sheet, each of the rails having ends. The pins are secured to the rails and longitudinally extend from the ends of the rails. The first sheet is curved laterally about an axis of curvature.

Another aspect of the present invention is a method for manufacturing a curved panel that includes the steps of: attaching pins to a flat sheet, wherein the pins longitudinally extend from opposite ends of the panels; curving the flat sheet about an axis of curvature so that the pins are positioned about the axis; passing the pins that extend from one end of the sheet through holes defined by a first end member; and passing the pins that extend from the other end of the sheet through holes defined by a second end member, whereby the sets of pins coact with the first end member and the second end member to maintain the first sheet in a curved state, thereby forming a curved panel.

Another aspect of the present invention is a curved panel that includes a sheet which in a free state is flat, a plurality of pins secured to opposite ends of the sheet, and one or more members for engaging the pins to maintain the sheet in a curved state.

A further aspect of the present invention is a method for manufacturing a curved panel, including the steps of: securing a plurality of pins to opposite ends of a flat sheet; curving the flat sheet about an axis of curvature; and securing the pins to one or more members having holes so as to maintain the sheet in a curved state, thereby forming a curved panel.

DESCRIPTION OF THE PREFERRED EMBODIMENTS

Figure 1:
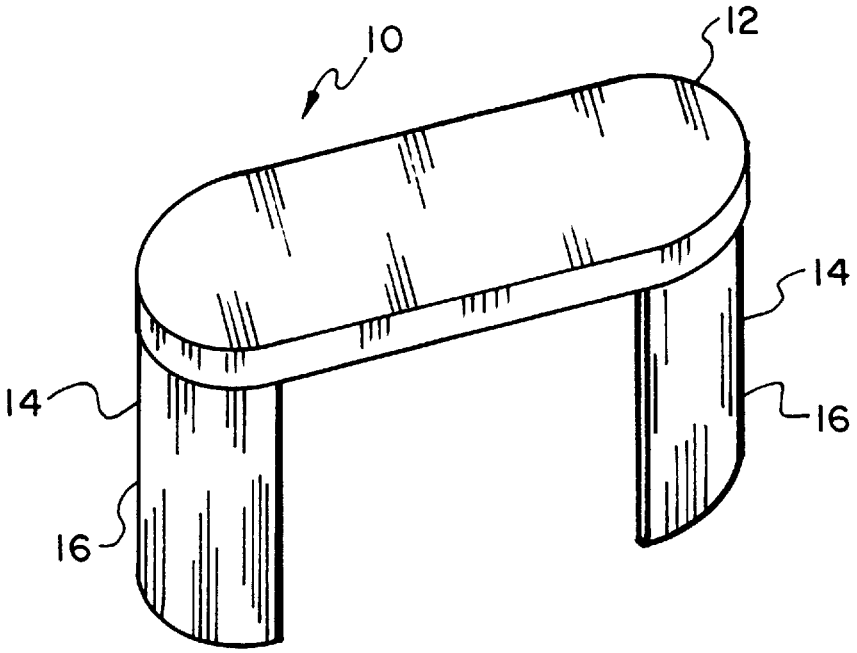
FIG. 1 is a top perspective view of a table with a curved panel made in accordance with the present invention.
Figure 2:
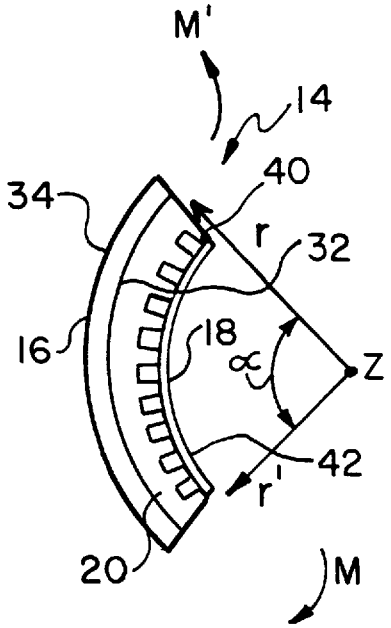
FIG. 2 is a top plan view of a curved panel made in accordance with the present invention.
Figure 3:
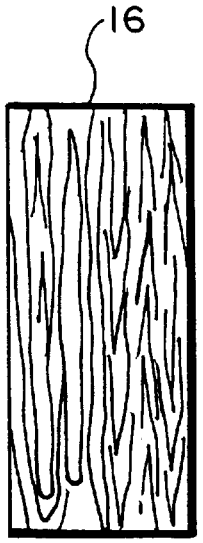
FIG. 3 is a front side elevational view of the curved panel shown in FIG. 2.

FIGS. 1–12 show a first embodiment of the present invention. FIG. 1 shows a table 10, including a flat table top 12 and curved legs or panels 14 made in accordance with the present invention. Referring to FIGS. 2, 3 and 9*b*, each panel 14 is made from two spaced apart sheets 16 and 18 sandwiching a frame made of a plurality of rails.

Figure 4:
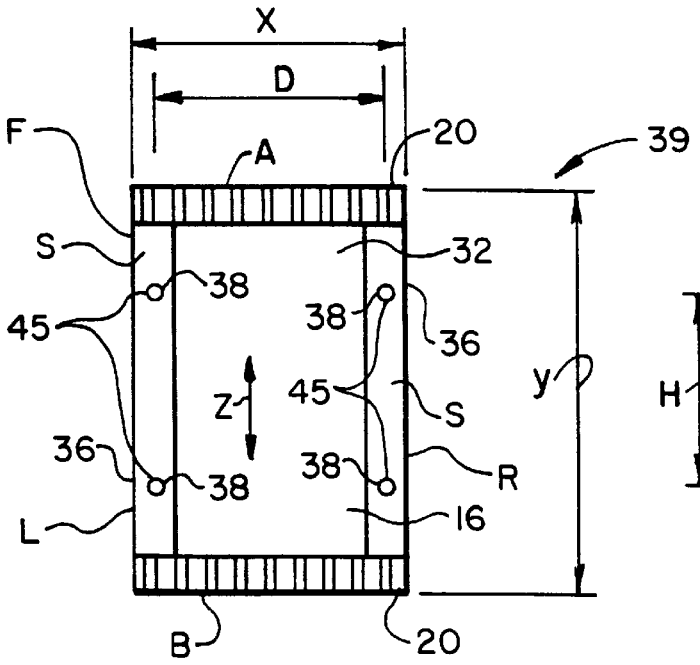
FIG. 4 is a top plan view of a first sheet having slotted rails which form a portion of the curved panel shown in FIGS. 2 and 3.
Figure 5:
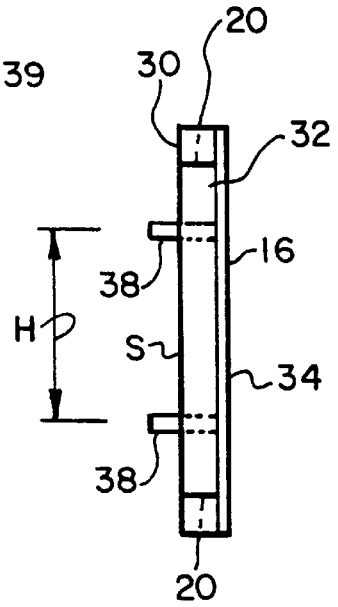
FIG. 5 is a side elevational view of the portion of the curved panel shown in FIG. 4.
Figure 6:
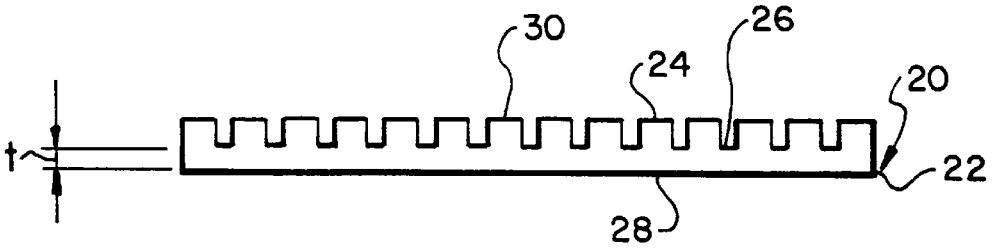
FIG. 6 is a side elevational view of one of the slotted rails shown in FIG. 4 prior to being curved.
Figure 7:
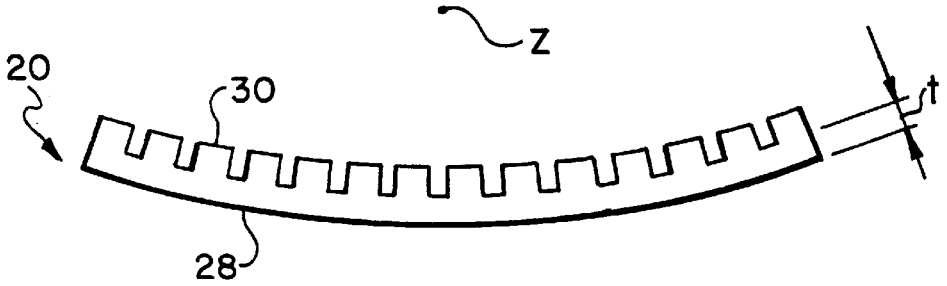
FIG. 7 is a side elevational view of the slotted rail shown in FIG. 6 in a curved state.

As shown in FIGS. 4–6, two spaced apart slotted or curvable rails 20 are secured to an upper end "A" and a lower end "B" of the rectangularly shaped flat sheet 16. The slotted rails 20 extend in a lateral direction. Each slotted rail 20 includes a base 22 having a plurality of extending ribs 24. Adjacent rib side surfaces define slots 26. Preferably, the slotted rail 20 is made of wood, such as pine, although it can be made of other materials, such as plastic or offal, and is initially substantially straight as shown in FIG. 6. A base surface 28 and rib surfaces 30 are defined on opposite sides of each slotted rail 20. The thickness "t" of the base 22 must be sufficient so that the base 22, and in turn the slotted rail 20, can be curved about a longitudinal axis of curvature "Z" as shown in FIG. 7. The base surface 28 of each slotted rail 20 abuts against an inner surface 32 of sheet 16 as shown in FIGS. 4 and 5. The slotted rail 20 attaches to the inner surface 32 of the sheet 16 by either an adhesive or fasteners, such as nails or screws.

Flat, rectangularly shaped non-curvable side rails 36 longitudinally extend along and are positioned adjacent to a left edge "L" and a right edge "R" of the sheet 16. Each side rail 36 includes two spaced apart pins 38 that extend beyond an exposed surface "S" of the side rails 36 and are positioned near opposite edges "L" and "R". Pins 38, which are secured to the side rails 36, are preferably cylindrically shaped and can be made of metal, plastic or wood. Side rails 36 can be made of wood, such as a pine, a laminated wood product, such as plywood or particle board, offal or a plastic material. Side rails 36 can be adhesively secured or mechanically secured to the sheet 16. Side rails 36 and slotted rails 20 form a frame "F" about the perimeter of the sheet 16. The frame and sheet arrangement, as described above, defines a subpanel 39.

Figure 8:
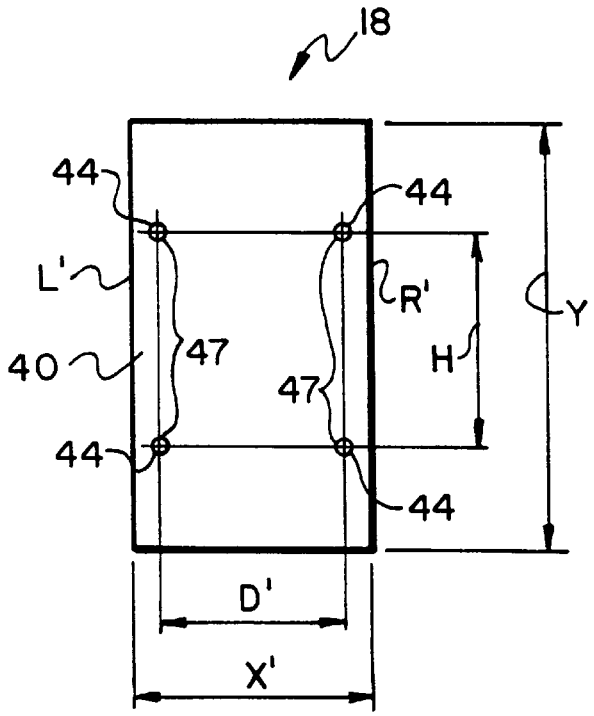
FIG. 8 is a top plan view of a second sheet that forms a portion of the curved panel shown in FIGS. 2 and 3.
Figure 9A:
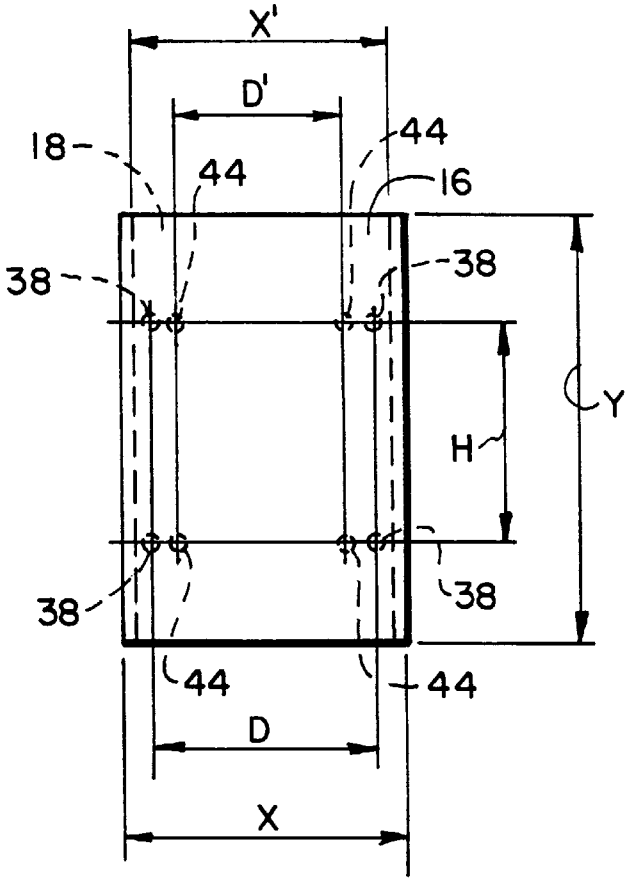
FIG. 9*a* is a top plan view of the first sheet positioned above the second sheet, where sheets are in an uncurved state.
Figure 9B:
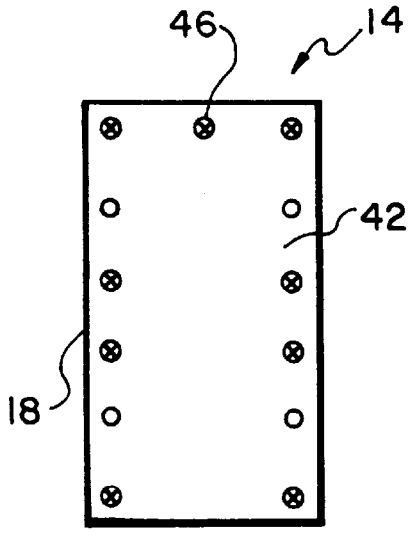
FIG. 9*b* is a rear side elevational view of the curved panel shown in FIGS. 2 and 3.

Referring to FIGS. 8 and 9*b*, rectangularly shaped flat sheet 18 includes an inner surface 40, an outer surface 42 and two pairs of pin receiving holes 44. Two spaced apart pin receiving holes 44 are positioned near a left edge "L'", and two spaced apart pin receiving holes 44 are positioned near the right edge "R'". The pin receiving holes 44 are approximately positioned and dimensioned to matingly receive pins 38 when sheets 16 and 18 are in a curved state.

Preferably, sheets 16 and 18 are made of particle board, where inner surfaces 32 and 40 are unfinished and outer surfaces 34 and 42 are finished. Sheets 16 and 18 each extend laterally and longitudinally. As shown in FIGS. 4 and 5, sheet 16 has a lateral dimension "X" and a longitudinal dimension "Y". The longitudinal spacing of pins 38 on each side rail 36 is a distance "H" and the lateral spacing of sets of pins 45 is a distance "D". Referring to FIG. 8, sheet 18 has a lateral dimension "X'" and a longitudinal dimension "Y", where "X" is greater than or equal to "X'". The longitudinal spacing of pin receiving holes 44 adjacent each edge "L'" and "R'" is a distance "H" and the lateral spacing of sets of holes 47 is a distance "D'", where "D" is greater than "D'". Referring to FIG. 9*a*, sheets 16 and 18 are placed on top of each other so that inner surfaces 32 and 40 face each other. As is apparent, the pins 38 do not align with pin receiving holes 44.

Figure 10:
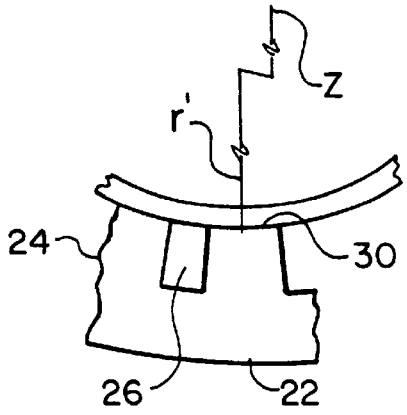
FIG. 10 is a top plan view of a portion of the curved panel shown in FIGS. 2 and 3.

The curved panel 14 is assembled as follows. First, the subpanel 39, including sheet 16, is laterally curved or bent about the "Z" axis so that the laterally extending slotted rails 20 are curved about the "Z" axis to form an arc of a circle as shown in FIG. 7. The rib surfaces 30 define a concave shape and the base surface 28 defines a convex shape. Likewise, the sheet 18 is curved about the "Z" axis so that the pins 38 are aligned with respective pin receiving holes 44 and the inner surface 40 defines a convex shape and the outer surface 42 defines a concave shape. Sheets 16 and 18 are then brought together so that inner surface 40 of the sheet 18 abuts against the rib surfaces 30 and exposed surfaces 39 and pins 38 pass through pin receiving holes 44 so as to maintain the sheets 16 and 18 in a curved state. The slotted rails 20 and side rails 36 are sandwiched between sheets 16 and 18. The pins 38 cooperate with the surface that defines the pin receiving holes 44 so as to form a stop to maintain the sheets 16 and 18 and the slotted rails 20 in a predetermined curved state. Although the rib surfaces 30 can be flat, it is also possible that the surfaces can have a slight curvature having a radius "r'" as shown in FIG. 10. As shown in FIG. 9*b*, fasteners 46, such as screws, then pass through the sheet 18 and into the slotted rails 20 and the side rails 36 so as to fixedly secure sheet 18 to sheet 16 resulting in the curved panel as shown in FIGS. 1–3 and 9*b*. Referring to FIG. 2, it can be seen that "X"=$\alpha$r and "X'"=$\alpha$r'; where $\alpha$ is the angle subtended by the arc defined by the sheets 16 and 18, which are now curved, and is measured in radians; and "r" and "r'" are radii of curvature as measured from the "Z" axis. The pins 38 coacting with pin receiving holes 44 permit consistent curved sheets to be formed, all of which subtend the angle $\alpha$ so as to maintain the sheets in a predetermined curved state. After the curved panels 14 are formed, they are attached to the top 12 in a manner well known in art to form the table 10.

Figure 11:
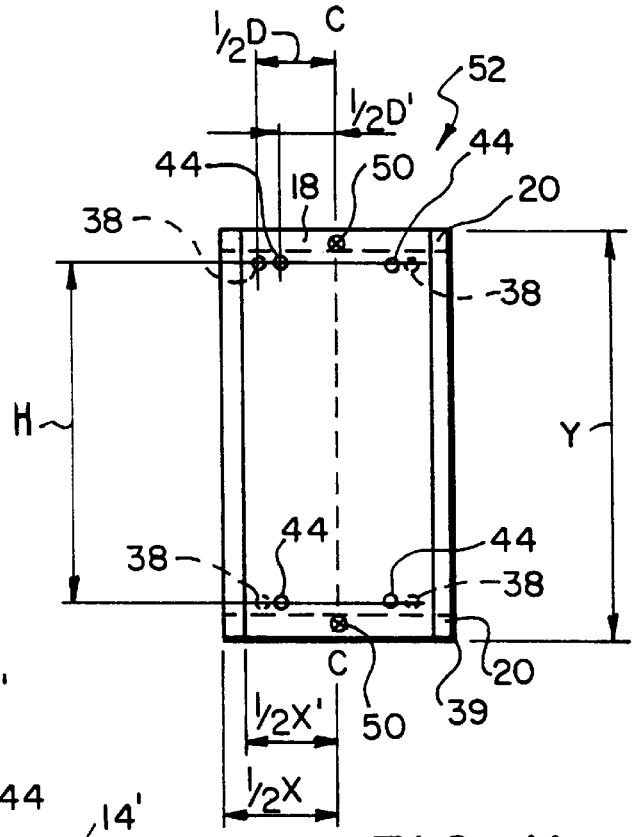
FIG. 11 is a top plan view of a flat panel prior to the panel being curved made in accordance with the present invention.
Figure 12:
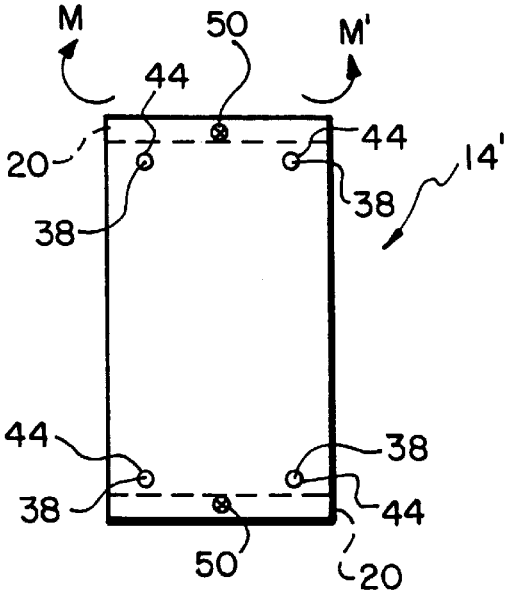
FIG. 12 is a rear side elevational view of a curved panel made from the flat panel shown in FIG. 11.

Alternatively, a curved panel 14', as shown in FIG. 12, similar to curved panel 14, can be assembled as follows. Curved panel 14' includes all of the same elements as curved panel 14, with the exception of the number of fasteners 46. Therefore, like reference numerals will be used for like elements. First, flat sheet 18 is secured to subpanel 39 so that the inner surface 40 of the sheet 18 abuts the rib surfaces 30, and the inner surface 40 of sheet 18 faces the inner surface 32 of sheet 16. Then, sheets 16 and 18 are aligned about a longitudinally extending center axis "C" so that one-half of each sheet 16 and 18 is positioned on opposite sides of the axis "C". Two fasteners 50, such as screws, secure the sheet 18 to respective slotted rails 20 and thereby securing sheet 18 to subpanel 39 to form a substantially flat panel 52. Specifically, pins 38 abut against inner surface 40 causing sheet 18 to slightly curve about the "Z" axis while sheet 16 remains flat. As can be seen in FIG. 11, the pins 38 are not aligned with the holes 44. Substantially flat panel 52 is then curved about the "Z" axis so that the slotted rails 20 and sheets 16 and 18 are curved about the "Z" axis until pins 38 engage in pin receiving holes 44 and form the curved panel 14' as shown in FIG. 12. Curved panel 14' is similar to curved panel 14, except no further fasteners are necessary to hold the sheets in place. Inner surface 40 of sheet 18 and outer surface 34 of sheet 16 are convex shaped and outer surface 42 of sheet 18 and inner surface 32 of sheet 16 are concave shaped. The sheets 16 and 18 initially will apply moments to the curved panel 14' as indicated by the arrows "M" and "M'" in an effort to straighten the panel. However, the pins 38 coact through frictional forces and compressive forces with surfaces of the sheet 18 that define pin receiving holes 44 and, in conjunction with fasteners 50, prevent the curved panels 14' from straightening into the substantially flat panel 52, thereby maintaining curved panel 14' and in turn, sheets 16 and 18 and slotted rails 20 in a curved state. Additional fasteners can then pass through sheet 18 and slotted rails 20 securing sheet 18 to slotted rails 20, such as shown in FIG. 9*b*, thereby converting curved panel 14' to curved panel 14.

FIGS. 13–19 show a second embodiment of the present invention, where the curved legs or panels 14 can be substituted with curved legs or panels 114 made in accordance with the present invention. Each curved panel 114 is made from two spaced apart sheets 116 and 118 sandwiching a frame 120 made of a plurality of rails 122 and a plurality of spaced blocks 124 that extends about a perimeter of the sheets 116 and 118 and sandwiching support blocks 130.

Figure 14:
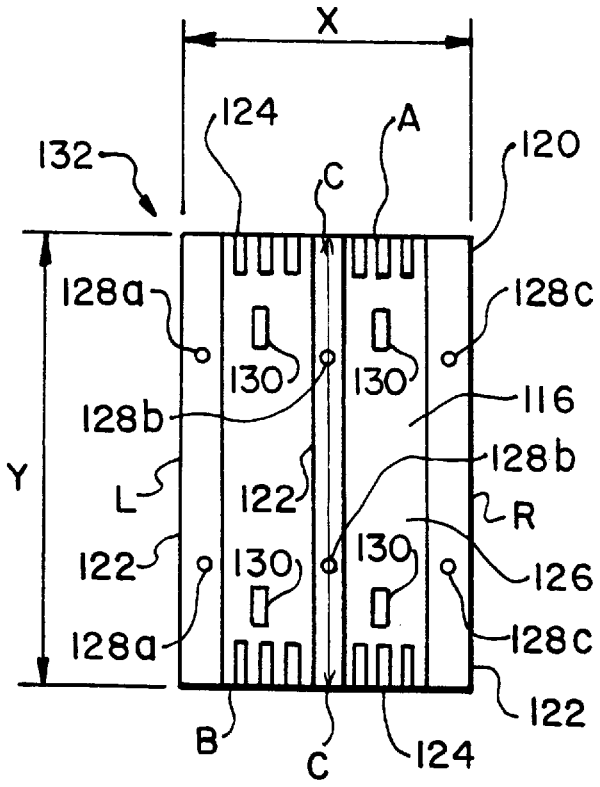
FIG. 14 is a side elevational view of a first sheet having rails and spaced blocks which form a portion of the curved panel shown in FIG. 13.
Figure 15:
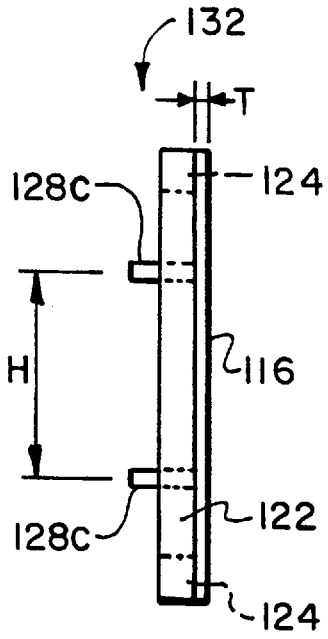
FIG. 15 is a side elevational view of a portion of the curved panel shown in FIG. 14.
Figure 16:
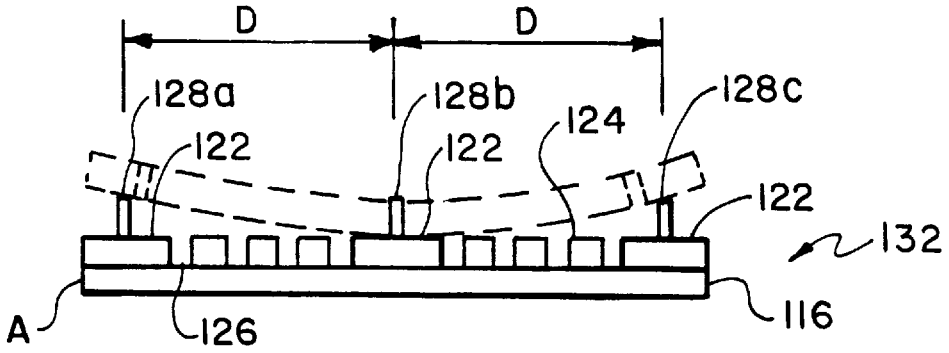
FIG. 16 is a side elevational view of a portion of the curved panel shown in FIGS. 14 and 15 in a flat state.

As shown in FIGS. 14–16, a plurality of spaced blocks 124, preferably evenly spaced, extend laterally across an upper edge or first edge "A" and an opposite lower edge or second edge "B" of the rectangularly shaped flat sheet 116 so that the spaced blocks 124 are positioned along opposite edges "A" and "B". The spaced blocks 124 are secured to sheet 116. Two flat, rectangularly shaped non-curvable rails 122 longitudinally extend along and are positioned adjacent to a left edge or third edge "L" and an opposite right edge or fourth edge "R" of the sheet 116 and along a center line "C" of the sheet 116. Edges "A" and "B" are transverse to edges "L" and "R". Each of the rails 122 and spaced blocks 124 has inner surfaces which abut an inner surface 126 of the sheet 116. Sheet 116 also includes an outer surface 127. Preferably, the rails 122 and spaced blocks 124 are adhesively secured to the sheet 116, but they can also be secured by fasteners, such as nails or screws. Preferably, the rails 122 and spaced blocks 124 are made of offal particle board, although they can be made from any other material. The sheet 116 should have a length "X", width "Y" and thickness "T" sufficient for easy bending about a longitudinal axis of curvature "Z". One example of a sheet 116 is "X"=29.5 inches; "Y"=29 inches; and "T"=0.100 inches.

Each rail 122 includes two spaced apart holes, each of which contains three pairs of spaced apart cylindrical pins 128*a*, 128*b* and 128*c* that extends above an exposed surface of the rails 122. Therefore, sets of pins 128*a* and 128*c* are attached to and are provided on rails 122 that extend along edges "R" and "L" and set of pins 128*b* positioned between them. Rails 122 and spaced blocks 124 form a frame 120 that extends about a perimeter of the sheet 116. Additional support blocks 130, which are optional, are positioned within the frame perimeter and secured to the sheet 116. Sheet 116, rails 122 and spaced blocks 124 form a subpanel 132.

Figure 13:
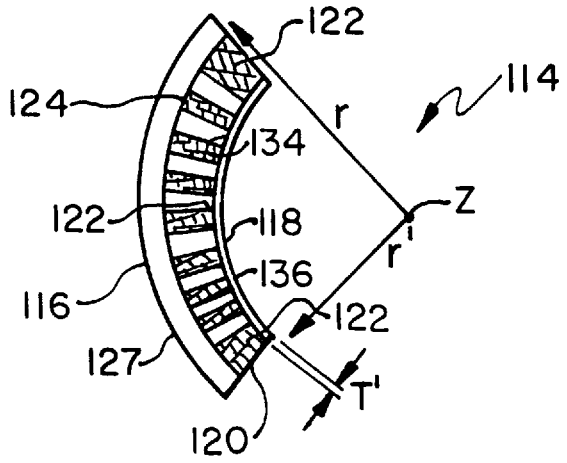
FIG. 13 is a top plan view of another embodiment of a curved panel made in accordance with the present invention.
Figure 18:
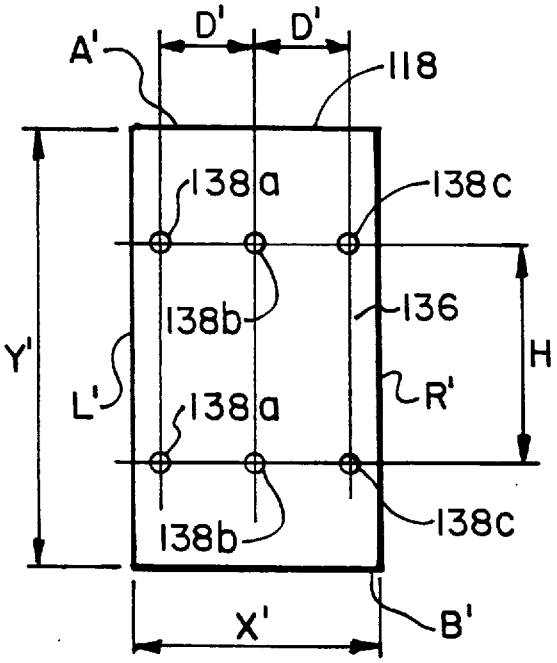
FIG. 18 is a top plan view of a second sheet that forms a portion of the curved panel shown in FIG. 13.

Referring to FIGS. 13 and 18, rectangularly shaped flat sheet 118 includes an inner surface 134 and an outer surface 136 and defines three pairs of spaced apart pin receiving holes 138*a*, 138*b* and 138*c*. Pin receiving hole 138*a* is positioned near a right edge of the sheet, pin receiving hole 138*b* is positioned along a center of the sheet 118 and pin receiving hole 138*c* is positioned near a left side of the sheet 118. The pairs of spaced apart pin receiving holes 138*a*, 138*b* and 138*c* are positioned and dimensioned to matingly receive the three pairs of spaced apart pins 128*a*, 128*b* and 128*c* when the subpanel 132 and the sheet 118 are in a curved state. The sets of pins 128*a*, 128*b* and 128*c* interact with surfaces of sheet 118 that define pin receiving holes 138*a*, 138*b* and 138*c* to maintain sheets 116 and 118 in a curved state. The sheet 118 has a length "X'", a width "Y'" and a thickness "T'" sufficient for easy bending about a longitudinal axis of curvature. One example of a sheet 118 is "X'"=29.5 inches; "Y'"=29 inches; and "T'"=0.100 inches.

Preferably, inner surfaces 126 and 134 are unfinished and outer surfaces 127 and 136 of the sheets 116 and 118, respectively, are finished. The sheet 118 has opposite edges "A'" and "B'" and opposite edges "R'" and "L'", where the edges "A'" and "B'" are transverse to edges "R'" and "L'".

The longitudinal spacing of the centers of each pair of pin receiving holes 138*a*, 138*b* and 138*c* equals "H", which is the same as the longitudinal spacing of the corresponding center of sets of pins 128*a*, 128*b* and 128*c*. Adjacent sets of pins 128*a*, 128*b* and 128*c* are laterally spaced a distance "D" from each other and adjacent sets of pin receiving holes 138*a*, 138*b* and 138*c* are spaced a distance "D'" from each other. Sheets 116 and 118 extend in a lateral direction and a longitudinal direction. Longitudinal dimensions "Y" and "Y'" of sheets 116 and 118 are equal and lateral dimension "X" is also equal to lateral dimension "X'" of sheets 116 and 118. The lateral dimension "X" can also be greater than "X'" to compensate for geometric changes due to curving the sheets. The spaced blocks 124 extend in the lateral direction. The lateral spacing "D" of adjacent sets of pins 128*a*, 128*b* and 128*c* is greater than the lateral spacing of adjacent sets of pin receiving holes 138*a*, 138*b* and 138*c*. The lateral spacing "D" and "D'" are defined by a radius of curvatures "r" and "r'" of the two sheets 116 and 118.

Assembly of the curved panels 114 is set forth as follows. First, as shown in FIG. 16, sheet 118 in phantom is placed on top of the subpanel 132 so that inner surfaces 126 and 134 face each other and the set of pins 128*b* align with and pass through the set of pin receiving holes 138*b*. Initially, sets of pins 128*a* and 128*c* do not align with sets of pin receiving holes 138*a* and 138*c*. Next, mechanical fasteners, such as screws 139, drive rivets or nails, are passed through sheet 118 into the middle rail 122 to secure sheet 118 to the subpanel 132 forming a substantially flat assembly or panel. This assembly, which includes sheets 116 and 118 and spaced blocks 124, is then curved about the axis of curvature "Z" so that sets of pins 128*a* and 128*c* are aligned and pass through respective sets of pin receiving holes 138*a* and 138*c*, and the spaced blocks 124 are moved relative to each other and the axis of curvature "Z".

Figure 17:
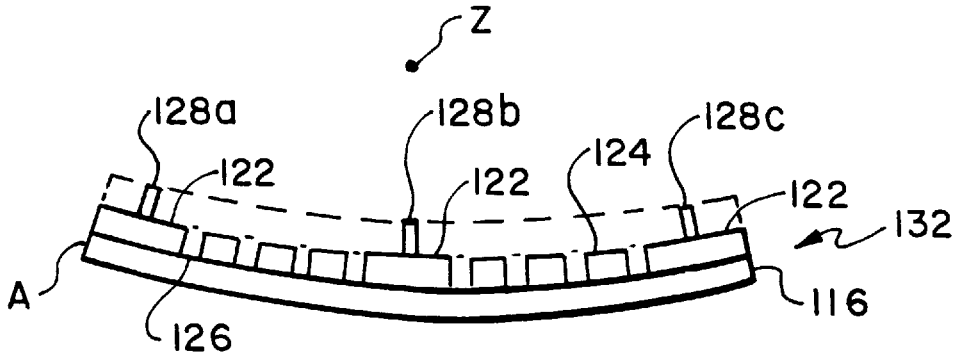
FIG. 17 is a side elevational view or a portion of the curved panel shown in FIG. 16 in a curved state.

FIG. 17 shows the subpanel 132 and sheet 118 in phantom in a curved state. The inner surface 126 of sheet 116 defines a concave shape and the outer surface 127 of sheet 116 defines a convex shape. At the appropriate curvature of the panels, sets of pins 128*a* and 128*c* will snap into their respective holes temporarily maintaining the assembly in a curved shape so that the blocks are positioned along opposite edges "A", "A'", "B" and "B'" of the sheets 116 and 118 and the edges "A", "A'", "B" and "B'" are curved about the axis of curvature "Z". In this arrangement, sheets 116 and 118 are temporarily secured to each other.

Figure 19:
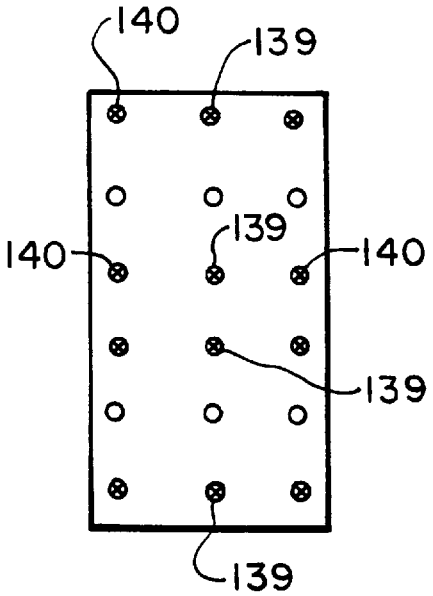
FIG. 19 is rear side elevational view of the curved panel shown in FIG. 13.

As shown in FIG. 19, additional fasteners 140, such as screws, are passed through sheet 118 and the side rails 122, permanently securing the sheet 118 to subpanel 132, which includes sheet 116 forming the curved panels 114. Additional fasteners can be used to attach sheet 118 to appropriate spaced block 124 and/or support block 130. The sets of pins 128*a*, 128*b* and 128*c* coacting with the pin receiving holes 138*a*, 138*b* and 138*c* permit the curved panels to be formed in a predetermined state. Once the additional fasteners are used to permanently affix sheet 118 to the subpanel 132 forming the rigid curved panel 114, then the panel 114 can be attached to the top 12 in a manner well known in the art to form the table 10 as shown in FIG. 1.

Figure 20:
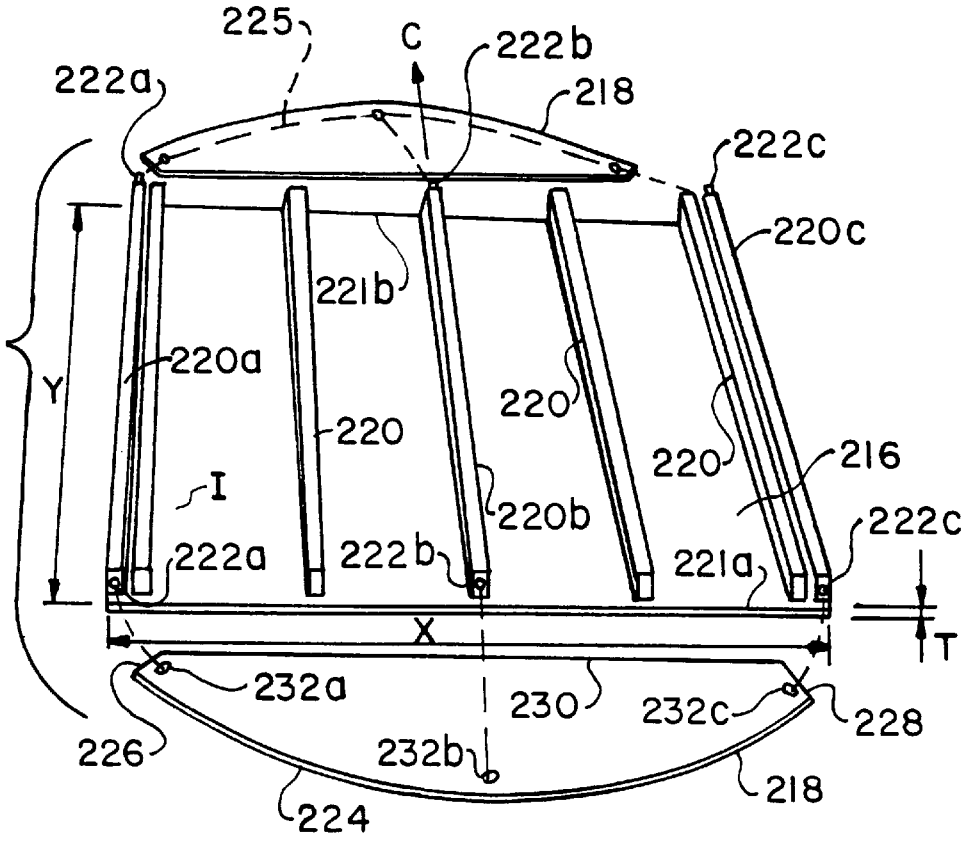
FIG. 20 is an exploded rear perspective view of another curved panel made in accordance with the present invention.
Figure 21:
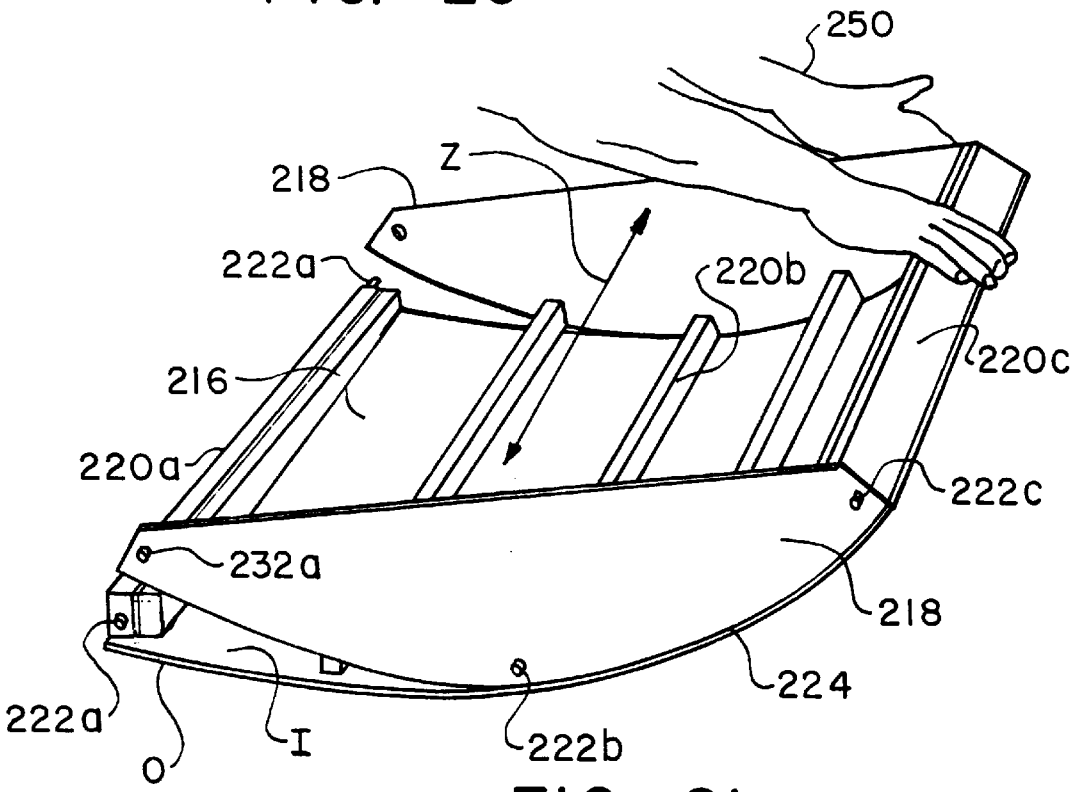
FIG. 21 is a rear perspective view of the curved panel shown in FIG. 20 in a partially assembled state.
Figure 22:
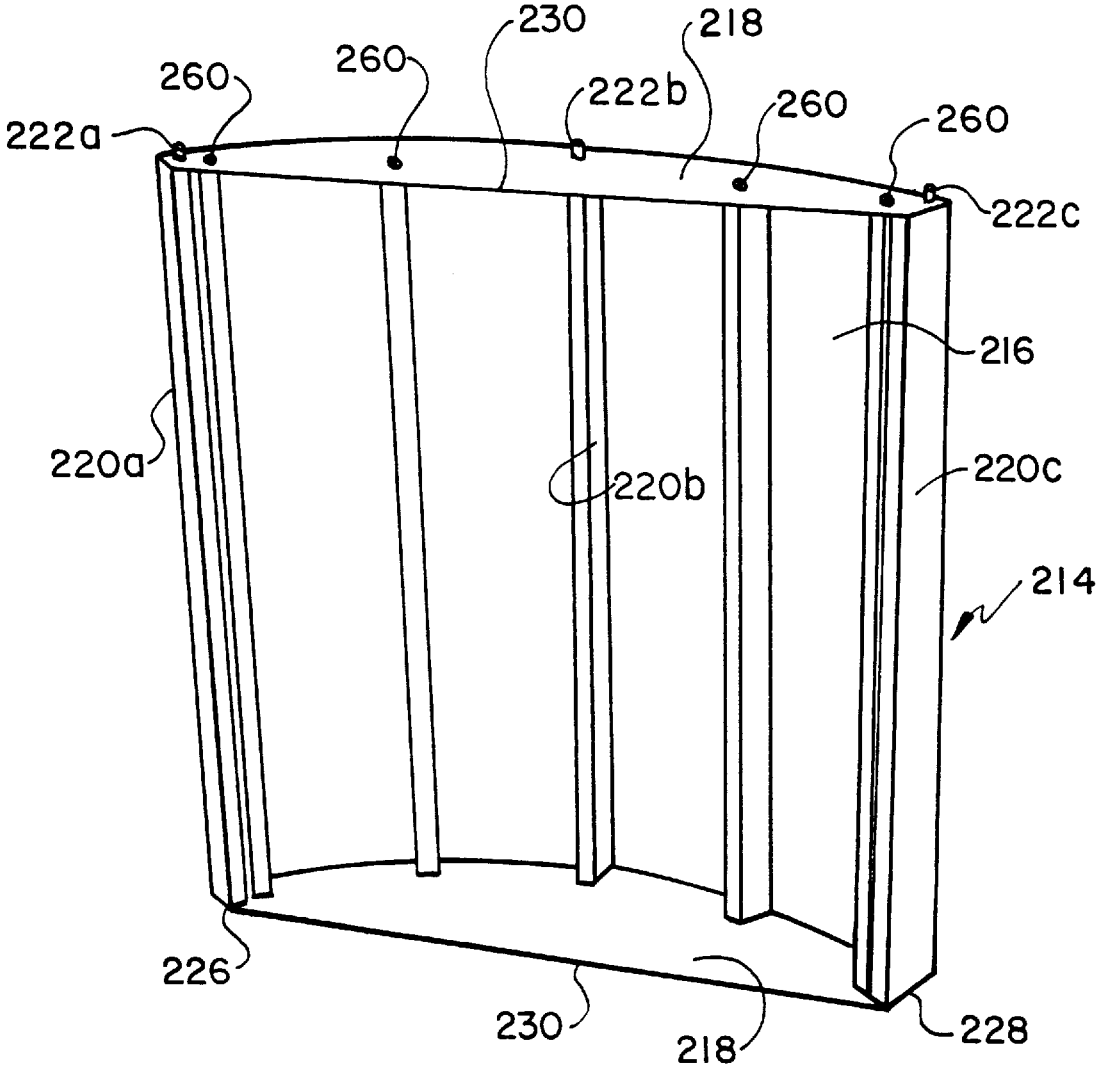
FIG. 22 is a rear perspective view of a curved panel shown in FIGS. 20 and 21.

FIGS. 20–22 show a third preferable embodiment of curved panel 214 made in accordance with the present invention, which can be substituted for curved legs or panels 14 and/or 114. Each curved panel 214 is made from a first sheet 216, two spaced apart template guides or end members 218 and a plurality of longitudinally extending and laterally spaced rails 220, 220*a*, 220*b* and 220*c*. Sheet 216 has the same dimensions "X", "Y" and "T" as sheet 116 and is preferably made of a similar material. Preferably, sheet 216 has a finished outer surface "O" and an unfinished inner surface "I". The plurality of rails are secured or attached to the inner surface "I" of the sheet 216 either by an adhesive or by mechanical fasteners. Rail 220*a* extends along a left edge of sheet 216; rail 220*b* extends along a center line "C'"; and rail 220*c* extends along a right side of the sheet 216. The other rails 220 can be secured to the sheet as shown.

Three sets of cylindrical guide pins 222*a*, 222*b* and 222*c* are attached to and extend from opposite ends 221*a* and 221*b* of rails 220*a*, 220*b* and 220*c* so that the sets of pins are attached to and extend from opposite ends 221*a* and 221*b* of the sheet 216.

Each of the template guides 218 includes a body having four edges 224, 226, 228 and 230, wherein edge 224 is in the shape of an arc of a circle. Three pin receiving holes 232*a*, 232*b* and 232*c* are defined near edge 224. Center of holes 232*a*, 232*b* and 232*c* lie on an arc 225 of a circle.

To assemble the curved panel 214, the sheet 216 is curved by an assembler 250 laterally about the axis of curvature "Z" until respective sets of guide pins 222*a*, 222*b* and 222*c*, which are positioned about the axis of curvature "Z", are received within and pass through pin receiving holes 232*a*, 232*b* and 232*c* of both template guides 218. The template guides 218 engage with the sets of pins 222*a*, 222*b* and 222*c* to maintain the sheet 216 in a curved state as shown in FIG. 22. The circle containing the centers of pin receiving holes 232*a*, 232*b* and 232*c* has a center position on the axis of curvature "Z". The sets of pins 222*a*, 222*b* and 222*c* coact with the template guides 218 to maintain sheet 216 in a curved state, thereby forming a curved panel. Template guides 218 are then fixedly or permanently attached to rails 220 and in turn, to sheet 216 by mechanical fasteners 260 or adhesive, thereby forming the curved panel 214. Edges 224 of the respective template guides 218 are positioned adjacent respective ends of the sheet 216 and have the same or similar radius of curvature as the outer curved surface "O" of the sheet 216. Edges 226 and 228 are angled and lie flush with respective outer surfaces of rails 220*a* and 220*c*. Exposed edges 230 lie in the same plane so that a flat back sheet (not shown) can be secured thereto by, for example, adhesive so as to form a closed panel.

Curved panels 14, 114 and 214 all include a sheet 16, 116 or 216, which in a free state, is flat. A plurality of pins are secured to opposite ends of the sheet so that one or more members can engage the pins to maintain the first sheet in a curved state. The curved panels are easily assembled by securing a plurality of pins to opposite ends or edges of the flat sheet, curving the flat sheet about the axis of curvature "Z" and securing the pins to one or more members having holes so as to maintain the sheet in a curved state, thereby forming a curved panel.

Figure 23:
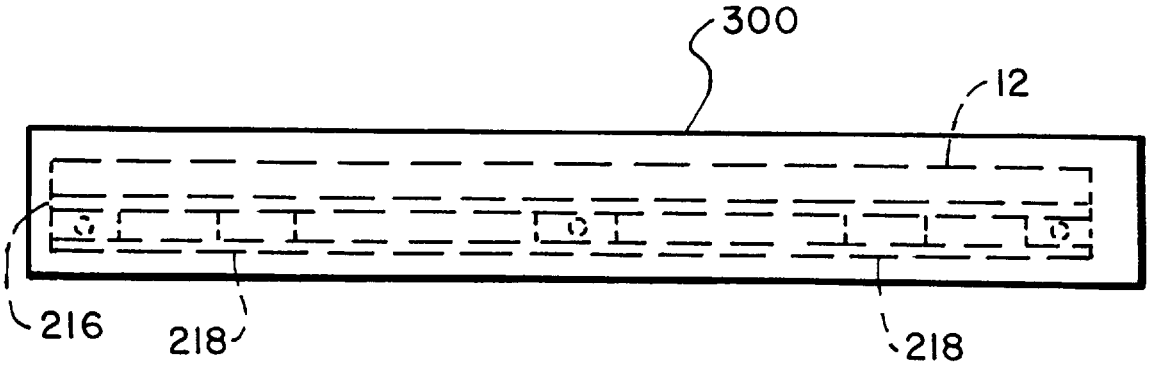
FIG. 23 is a side elevational view of a box containing flat panels and components to form curved panels for assembling a piece of furniture.

It should now be evident that the present invention permits flat components, such as sheets 16 and 18, rails 20 and 36, substantially flat panel 52, sheets 116 and 118, rails 122, spaced blocks 124 and support blocks 130, sheet 216, template guides 218 and/or rails 220, 220*a*, 220*b* and 220*c* to be boxed in a box 300, as shown in FIG. 23, with flat panels in the form of a kit that is used to assemble ready-to-assemble furniture. The box 300 containing the components is substantially smaller than one containing assembled curved panels. Additionally, the assembled curved panel would be liable to damage during the dynamics of a carton containing ready-to-assemble furniture. The purchaser then removes the components from the box 300 and easily assembles the curved panels at his or her home or office and attaches them to the flat panels and other components to form a piece of furniture. The present invention need not be limited to curved legs used in ready-to-assemble furniture, but can be used in any application where a curved panel is desired, such as, for example, a wall partition.

Having described the presently preferred embodiments of our invention, it is to be understood that it may otherwise be embodied within the scope of the appended claims.

We claim:

1. A method for manufacturing a curved panel, comprising the steps of:

a) attaching slotted rails to a flat first sheet;

b) attaching pins to one of said first sheet and a flat second sheet;

c) curving said first sheet and said slotted rails about an axis of curvature;

d) curving said second sheet about the axis of curvature; and e) securing said second sheet to said first sheet and forming a curved panel by passing said pins through holes defined in the other of said first sheet and said second sheet so as to maintain said first sheet and said second sheet in a curved state.

2. A method for manufacturing a curved panel, comprising the steps of:

a) attaching a plurality of spaced blocks to a flat first sheet;

b) attaching pins to one of said first sheet and a second sheet;

c) curving said first sheet and moving said blocks relative to each other about an axis of curvature;

d) curving said second sheet about the axis of curvature; and e) securing said second sheet to said first sheet to form a curved panel by passing said pins through holes defined in the other of said first sheet and said second sheet so as to maintain said first sheet and said second sheet in a curved state.

3. A method for manufacturing a curved panel as claimed in claim 2, wherein said pins temporarily secure said first sheet to said second sheet, said method further comprising the step of permanently fastening said second sheet to said first sheet.

4. A method for manufacturing a curved panel, comprising the steps of:

a) attaching pins to a flat sheet, wherein said pins longitudinally extend from opposite ends of said flat sheet;

b) curving said flat sheet about an axis of curvature so that said pins are positioned about said axis;

c) passing said pins that extend from one end of said sheet through holes defined by a first end member; and d) passing said pins that extend from the other end of said sheet through holes defined by a second end member, whereby sets of said pins coact with said first end member and said second end member to maintain said sheet in a curved state, thereby forming a curved panel.

5. A method for manufacturing a curved panel as claimed in claim 4, further comprising the step of:

securing a plurality of rails to said sheet and attaching said sets of pins to said rails.

6. A method for manufacturing a curved panel as claimed in claim 4, further comprising the step of:

using mechanical fasteners to permanently secure said first end member and said second end member to said sheet.

7. A method for manufacturing a curved panel, comprising the steps of:

a) securing a plurality of pins to opposite ends of a flat sheet;

b) curving said flat sheet about an axis of curvature; and c) securing said pins to one or more members having holes so as to maintain said sheet in a curved state, thereby forming a curved panel.

8. A kit for manufacturing a piece of furniture, comprising:

a flat sheet;

pins adapted to be secured to opposite ends of said sheet; and means adapted for engaging said pins to maintain said sheet in a curved state, whereby said piece of furniture is manufactured by attaching said pins to said opposite ends of said sheet, curving said sheet and engaging said means with said pins to form a curved panel and securing said curved panel to said flat panel to form a piece of furniture.

9. A kit for manufacturing a piece of furniture as claimed in claim 8, further comprising:

a box containing said flat panel, said flat sheet, said pins and said means adapted for engaging said pins to maintain said sheet in a curved state, whereby said flat panel, said flat sheet, said pins and said means adapted for engaging said pins to maintain said sheet in a curved state are removed from said box to manufacture said furniture.

10. A method for manufacturing a piece of furniture having a curved panel, comprising the steps of:

a) attaching slotted rails to a flat first sheet;

b) attaching pins to one of said first sheet and a flat second sheet;

c) curving said first sheet and said slotted rails about an axis of curvature;

d) curving said second sheet about the axis of curvature;

e) securing said second sheet to said first sheet and forming a curved panel by passing said pins through holes defined in the other of said first sheet and said second sheet so as to maintain said first sheet and said second sheet in a curved state; and f) attaching said curved panel to a flat panel to form a piece of furniture.

11. A method for manufacturing a piece of furniture having a curved panel, comprising the steps of:

a) attaching a plurality of spaced blocks to a flat first sheet;

b) attaching pins to one of said first sheet and a second sheet;

c) curving said first sheet and moving said blocks relative to each other about an axis of curvature;

d) curving said second sheet about the axis of curvature;

e) securing said second sheet to said first sheet to form a curved panel by passing said pins through holes defined in the other of said first sheet and said second sheet so as to maintain said first sheet and said second sheet in a curved state; and f) attaching said curved panel to a flat panel to form a piece of furniture.

12. A method for manufacturing a piece of furniture having a curved panel, comprising the steps of:

a) attaching pins to a flat sheet, wherein said pins longitudinally extend from opposite ends of said flat sheet;

b) curving said flat sheet about an axis of curvature so that said pins are positioned about said axis;

c) passing said pins that extend from one end of said sheet through holes defined by a first end member;

d) passing said pins that extend from the other end of said sheet through holes defined by a second end member, whereby sets of said pins coact with said first end member and said second end member to maintain said sheet in a curved state thereby forming a curved panel; and e) attaching said curved panel to a flat panel to form a piece of furniture.

13. A method for manufacturing a piece of furniture having a curved panel, comprising the steps of:

a) securing a plurality of pins to opposite ends of a flat sheet;

b) curving said flat sheet about an axis of curvature;

c) securing said pins to one or more members having holes so as to maintain said sheet in a curved state thereby forming a curved panel; and d) attaching said curved panel to a flat panel to form a piece of furniture.

* * * * *